US011691432B2

(12) United States Patent
Malik et al.

(10) Patent No.: US 11,691,432 B2
(45) Date of Patent: Jul. 4, 2023

(54) AIR PURGER WITH PLUNGER

(71) Applicant: Hewlett-Packard Development Company, L.P., Spring, TX (US)

(72) Inventors: Craig L Malik, Corvallis, OR (US); Ronald J Ender, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 144 days.

(21) Appl. No.: 16/966,051

(22) PCT Filed: Feb. 26, 2018

(86) PCT No.: PCT/US2018/019645

§ 371 (c)(1),
(2) Date: Jul. 30, 2020

(87) PCT Pub. No.: WO2019/164526

PCT Pub. Date: Aug. 29, 2019

(65) Prior Publication Data

US 2020/0353755 A1 Nov. 12, 2020

(51) Int. Cl.
*B41J 2/19* (2006.01)
*B41J 2/175* (2006.01)

(52) U.S. Cl.
CPC ..... *B41J 2/19* (2013.01); *B41J 2/17596* (2013.01)

(58) Field of Classification Search
CPC ... B41J 2/165; B41J 2/175; B41J 29/17; B41J 2/19; B41J 2/17596
See application file for complete search history.

(56) References Cited

U.S. PATENT DOCUMENTS 2,000,218 A 5/1935 Carroll
4,301,459 A * 11/1981 Isayama ..... B41J 2/19 347/68
4,558,326 A * 12/1985 Kimura ..... B41J 2/175 347/68
5,847,734 A * 12/1998 Pawlowski, Jr. ..... B41J 2/1752 347/92
5,870,126 A 2/1999 Kondo
5,905,518 A * 5/1999 DeFilippis ..... B41J 2/17513 347/85
5,936,651 A * 8/1999 Uchida ..... B41J 2/2103 346/139 A
5,984,462 A 11/1999 DeFilippis
6,039,443 A 3/2000 Dunphy et al.
6,042,226 A 3/2000 Therien
6,139,138 A 10/2000 Powers et al.
6,193,363 B1 2/2001 Kelly
(Continued)

FOREIGN PATENT DOCUMENTS

CN 1374196 A 10/2002
CN 1914040 A 2/2007
(Continued)

*Primary Examiner* — Umashankar Venkatesan
(74) *Attorney, Agent, or Firm* — Brooks, Cameron & Huebsch, PLLC

(57) ABSTRACT

An example air purging device includes a removable housing. The removable housing includes a first fluid interface to fluidically couple a fluid tube to the housing and a bore housing a plunger. In an example, movement of the plunger from a first orientation to a second orientation allows for the removal of the removable housing.

20 Claims, 8 Drawing Sheets

(56) References Cited

U.S. PATENT DOCUMENTS

| | | | | |
|---|---|---|---|---|
| 7,114,801 | B2 | 10/2006 | Hall et al. | |
| 7,334,883 | B2 | 2/2008 | Campillo et al. | |
| 7,841,711 | B2 | 11/2010 | Matsumoto et al. | |
| 11,260,669 | B2 * | 3/2022 | Ortiz Mompel | B41J 2/19 |
| 2001/0040610 | A1 * | 11/2001 | Kurata | B41J 2/17556 347/85 |
| 2004/0183870 | A1 | 9/2004 | Steinmeiz et al. | |
| 2005/0253909 | A1 | 11/2005 | Usui | |
| 2006/0164478 | A1 | 7/2006 | Fukazawa | |
| 2006/0284948 | A1 | 12/2006 | Ikeda et al. | |
| 2007/0229582 | A1 | 10/2007 | Yano | |
| 2007/0285476 | A1 | 12/2007 | Freire et al. | |
| 2009/0179973 | A1 | 7/2009 | Yokouchi | |
| 2010/0309245 | A1 * | 12/2010 | Burroughs | B41J 2/17596 347/18 |
| 2017/0341410 | A1 * | 11/2017 | Otis | B41J 2/19 |
| 2021/0237465 | A1 * | 8/2021 | Li | B41J 2/175 |

FOREIGN PATENT DOCUMENTS

| | | | |
|---|---|---|---|
| CN | 101073949 | A | 11/2007 |
| CN | 102656015 | A | 9/2012 |
| CN | 20398358 | | 7/2013 |
| CN | 104162224 | A | 11/2014 |
| CN | 107848308 | A | 3/2018 |
| EP | 1595704 | | 11/2005 |
| EP | 2279868 | A1 | 3/2011 |
| JP | 62-109655 | A | 5/1987 |
| JP | 2003-094681 | A | 4/2003 |
| JP | 2007-268855 | A | 10/2007 |
| WO | WO-2011093838 | A2 | 5/2012 |
| WO | WO-2017036490 | W | 3/2017 |

* cited by examiner

AIR PURGER WITH PLUNGER

BACKGROUND

Printing devices include a carriage that includes a number of fluidic dies. The fluidic dies are supplied with a printing fluid such as ink during operation. In some printing devices, the printing fluid may be maintained within a reservoir separate from the fluidic dies and carriage. In these examples, the printing fluid is provided from the reservoirs to the fluidic dies on the carriage via a number of tubes.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
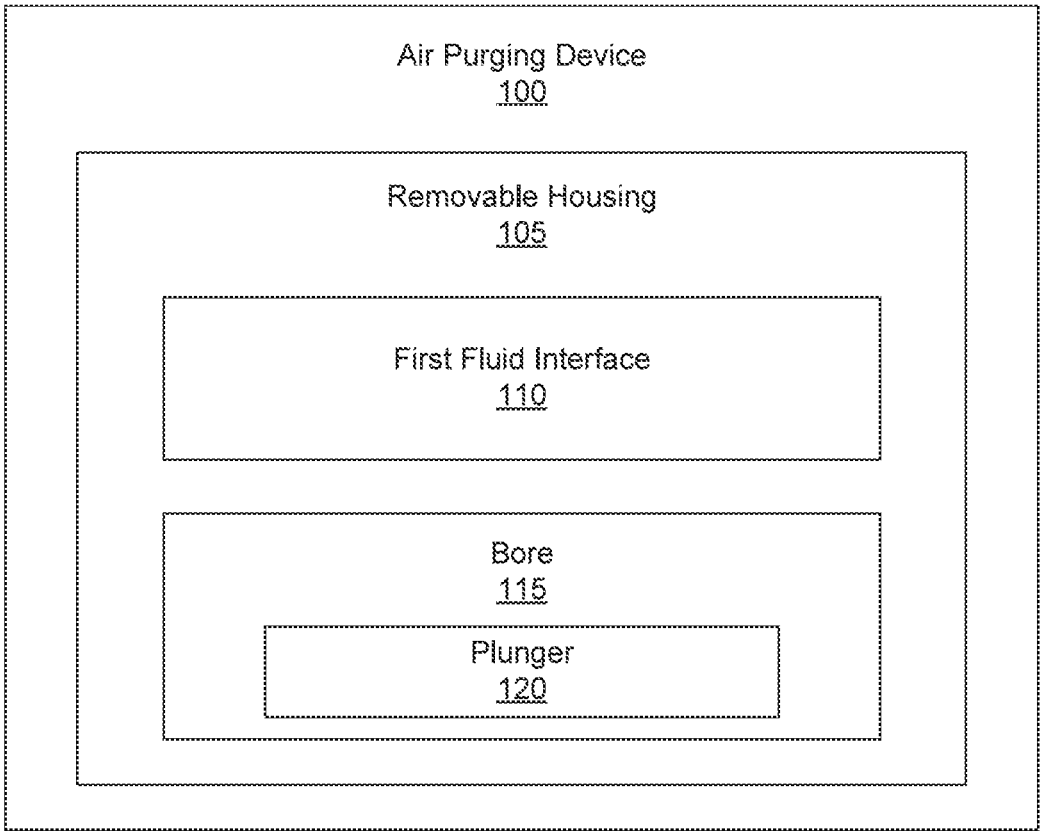
FIG. 1 is a block diagram of an air purging device according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printing devices include a printing fluid source that supplies a printing fluid to a number of fluidic dies conveyed and/or maintained on a carriage. The printing fluid source may be in the form of a reservoir that is fluidically coupled to the carriage via a number of tubes. The reservoir may be maintained within or without the printing device. Any number of reservoirs may be fluidically coupled to the fluidic dies by any number of tubes. In this example, the fluid reservoir may, when printing fluid is exhausted, be resupplied with printing fluid. The printing fluid maintained in the reservoirs may include any fluid used to form an image or object in the case of two-dimensional (2D) printing or three-dimensional (3D) printing, respectively. The present specification, therefore, contemplates that the reservoirs, fluid tubes, and/or fluid paths described herein may transport printing fluids such as binders, inks, build material, biological materials, medications, and chemical reagents, among other 2D and 3D printing materials.

In these examples, however, air present within the tubes may reach the fluidic dies after resupply and or an initial supply of the reservoir. Fluidic dies include a number of fluidic and/or microfluidic channels through which the printing fluid flows eventually to a number of ejection chambers. Presence of air within these fluidic and/or microfluidic channels as well as in the ejection chambers may cause damage to these components of the fluidic die. This results in a reduction of use and lifespan of the fluidic dies.

To reduce the amount of air that reaches the fluidic dies; the tubes fluidically coupling the reservoirs to the fluidic dies may be evacuated of air prior to coupling of the fluidic dies to the carriages.

The present specification describes an air purging device that includes a removable housing. In an example, the removable housing includes a first fluid interface to fluidically couple a fluid tube to the housing and a bore housing a plunger. In this example, movement of the plunger from a first orientation to a second orientation allows for the removal of the removable housing.

The present specification further describes an air purging system that includes a carriage comprising a first fluidic valve fluidically coupled, via a tube, to a fluid reservoir, and a housing. In this example, the housing includes a first fluid interface fluidically coupled to the first fluidic valve and a bore housing a plunger, wherein movement of the plunger from a first orientation to a second orientation allows for the removal of the housing from the carriage.

The present specification further describes a removeable air purging apparatus that includes a first fluidic interface to interface with a first fluid valve of a pen carriage; a bore; and a plunger within the bore to create a vacuum within the bore when the plunger is removed from the bore wherein placement of the plunger from a first orientation to a second orientation allows for the removeable air purging apparatus to be removed from a carriage.

As used in the present specification and in the appended claims; the term "fluid" is meant to be understood as a substance that continually deforms (flows) under an applied shear stress and may include liquids, gases, plasmas; and plastic solids. In some examples of the present specification, a fluid includes air and a printing fluid.

Turning now to the figures, FIG. 1 is a block diagram of an air purging device (100) according to an example of the principles described herein. The air purging device (100) includes a removable housing (105) that, in an example; is removed once air within a number of tubes fluidically connecting the air purging device (100) to a printing fluid reservoir is purged. The air purging device (100) may, in an example, be used in a printing system or device where a fluid reservoir is maintained separate from a carriage that holds and/or translates one fluidic die across a print medium. The fluid reservoir is fluidically coupled to the carriage that holds the air purging device (100). During initialization of the printing device, the tubes between the reservoir and the carriage are filled with an amount of air. Purging of this air prevents air from reaching the fluidic dies once the air purging device (100) is removed thereby extending the usable life of the fluidic dies.

The removable housing (105) may include a first fluid interface (110). The first fluid interface (110) may be used to interface with the carriage of the printing device while the air purging device (100) interfaces with the carriage. In an example, the carriage may include a manifold that interfaces with the first fluid interface (110) via a fluidic valve formed on the manifold of the carriage. The fluidic valve, in an example, may be a one-way valve such that air purged from the tubes by the air purging device (100) remains purged even when the air purging device (100) is removed from the carriage. In an example, the number of fluid interfaces (110) may match the number of fluidic valves formed on the manifold of the carriage which may also match the number of tubes connected to those fluidic valves. In an example, the number of fluid interfaces (110), fluidic valves, and tubes may match the number of types of printing fluid to be ejected from the fluidic dies when installed. However, the number of types of printing fluid may vary and any given set of tubes may convey the same type of printing fluid to the carriage, manifold, air purging device (100), and/or fluidic dies according to the principles described herein.

The removable housing (105) may also include a bore (115) defined in the housing and fluidically coupled to the first fluid interface (110). Fluidically coupling the bore (115) to the first fluid interface (110) allows for a vacuum to be formed therein as a plunger (120) is pulled or otherwise removed from the bore (115) during operation. The bore (115) may allow a portion of the plunger (120) to translate coaxially through the bore (115) so that the vacuum created pulls an amount of printing fluid from the reservoir fluidically coupled to the manifold via the tubes. As this happens, air downstream of the reservoir present in the tubes, one-way valves of the manifold and first fluid interface (110) is pulled into the bore (115). This may continue until the fluid reaches the one-way valve and/or the first fluid interface (110).

In an example, the plunger (120) may be placed into one of two orientations. In a first orientation, the plunger (120) is held within the bore (115) by a plunger retainer. The plunger retainer may interface with a feature on the plunger (120) that prevents coaxial movement of the plunger (120) within the bore (115). In a second orientation of the plunger (120), the plunger retainer may be bypassed and no longer interfacing with the feature on the plunger (120). The movement of the plunger (120) from the first orientation to the second orientation may be accomplished, in an example, by twisting the plunger (120) within the bore (115). In an example, twisting the plunger (120) within the bore (115) bypasses the plunger retainer allowing the plunger (120) to translate coaxially, such as to retract, within the bore (115). In this example, the plunger (120) is prevented from being fully removed from the bore (115) by an interfacing surface on the plunger (120).

The bore (115) may include a spring mounted within the bore (115) that is compressed when a portion of the plunger (120) is within the bore (115). As the plunger (120) is moved from the first orientation to the second orientation bypassing the plunger retainer, the force imposed by the spring may be applied to an end of the plunger (120) forcing the plunger (120) out of the bore (115). A seal may also be placed within the bore (115) between the interior walls of the bore (115) and the end of the plunger (120) so as to maintain a vacuum seal within the bore (115) as the plunger (120) is removed or partially removed from within the bore (115). This seal prevents the atmospheric pressure outside of the bore (115) from equalizing with the vacuum created within the bore (115) as the plunger (120) is displaced.

In an example, the first fluid interface (110) may further include a porous plug within the first fluid interface (110). The porous plug may be any type of plug that, when contacted by a fluid such as the printing fluid pulled through the tubes of the manifold, causes the first fluid interface (110) to plug up preventing the fluid from entering the bore (115) as well as air from entering the tube. In an example, the porous plug may be chemically treated such that when it comes in contact with the printing fluid, the chemicals in the porous plug coagulate or swell and form a plug such that printing fluid is not allowed to pass through the first fluid interface (110) and into the bore (115). The porous plug may be treated with, for example, a crosslinked polyacrylamide. As, for example, water in the printing fluid comes in contact with the crosslinked polyacrylamide, the porous plug may swell. In another example, a portion of the porous plug closest to the bore (115) may be treated with crosslinked polyacrylamide. As the printing fluid comes in contact with the front of the porous plug and is pushed through to the chemically treated portion of the porous, the chemicals may react with the printing fluid as described and create a solid plug. In this example, treating a portion of the porous plug closest to the bore (115) may prevent contamination of the printing fluid with the chemicals. Some chemicals used to treat the porous plug may leach into the printing fluid used during a printing process. Treating the back portion of the porous plug may prevent those chemicals from leaching into the supply of printing fluid. In an example, the porous plug may also prevent air from entering the tubes, one-way valves of manifold, and/or reservoir as the air purging device (100) is removed from the carriage.

In an example, the movement of the plunger (120) from the first orientation to the second orientation allows for the removal of the air purging device (100) from the carriage. In this example, the body of the plunger (120) may prevent a user from removing or accessing devices of the carriage that remove the air purging device (100) from the carriage. In an example, the plunger (120) includes a handle that blocks access to a latch used to secure the air purging device (100) to the carriage. When the plunger (120) is placed in the second orientation, the handle of the plunger (120) has been moved out of the way of the latch allowing the user to access the latch. In an example, during operation of the air purging device (100), a user may move the plunger (120) from the first orientation to the second orientation by accessing the handle of the plunger (120) and rotating the plunger (120) coaxially within the bore (115). As this occurs, the plunger retainer maintaining the plunger (120) within the bore (115) is bypassed allowing the plunger (120) to be translated coaxially within the bore (115). The translation may be assisted by the spring described herein to apply force to the plunger (120) to translate the plunger (120) coaxially within the bore (115). Otherwise, without the spring, in an example, a user may pull the plunger (120) coaxially a distance within the bore (115) using the handle. As the plunger (120) is moved coaxially a distance within the bore, a vacuum is created within the bore (115) causing printing fluid to be pulled from the reservoir, through the tubes fluidically coupling the air purging device (100) to the reservoir, and to the first fluid interface (110). As the printing fluid reaches the first fluid interface (110), the porous plug may prevent the printing fluid from entering the bore (115) as well as prevent air from reentering the tubes as described herein. With the plunger (120) in the second orientation, a latch used to secure the air purging device (100) to the carriage may be accessed allowing the user to remove the air purging device (100) and replace it with one fluidic die and/or housing associated with the fluidic die. In this way, the printing device may be prepared for use by the user while also preventing air from reaching the fluidic dies during such operation.

Figure 2:
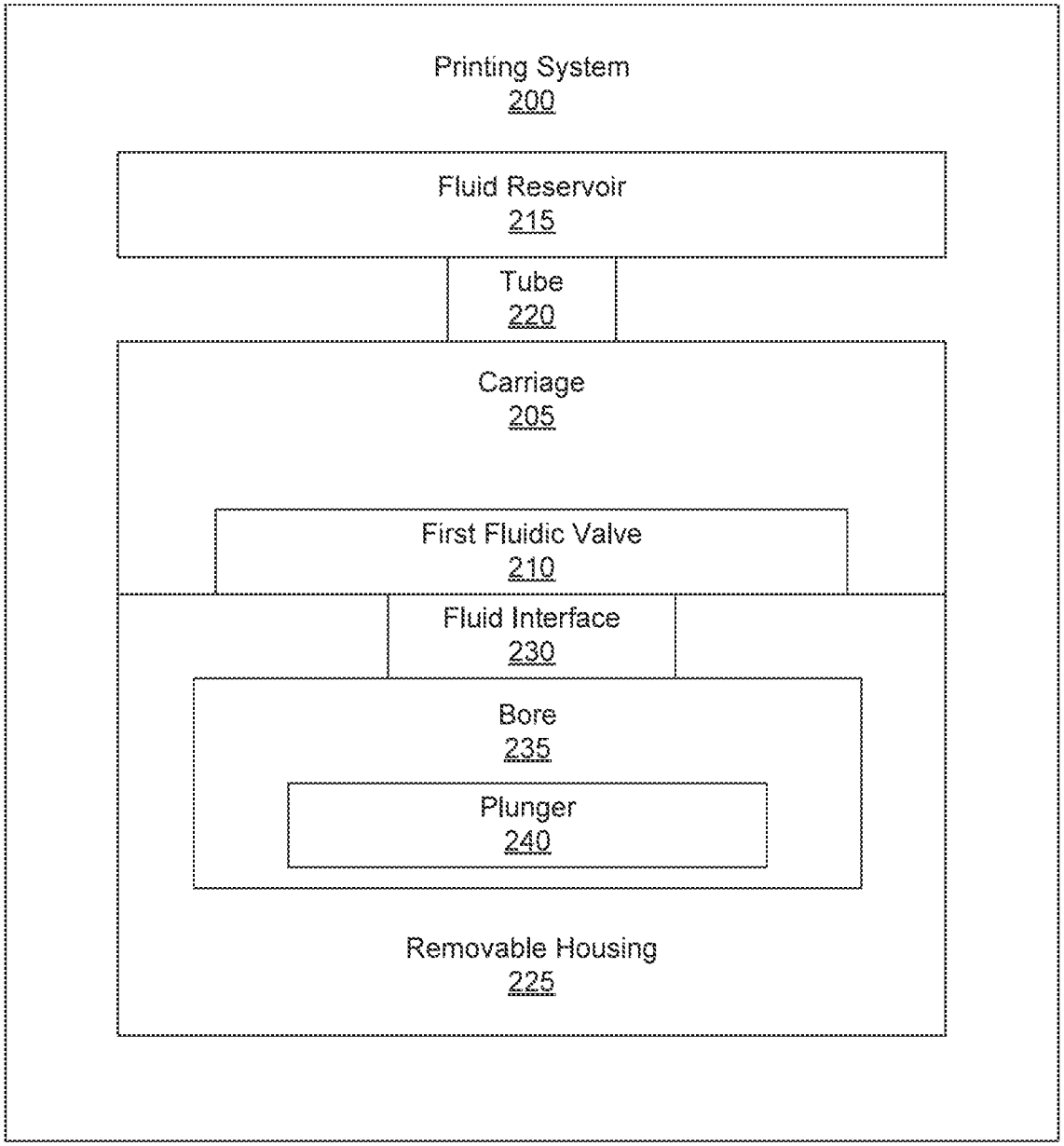
FIG. 2 is a block diagram of an air purging system according to an example of the principles described herein.

FIG. 2 is a block diagram of a printing system (200) according to an example of the principles described herein. The printing system (200) may, in an example, form a part of a printing device and may include elements that are removed from the printing device after purging air from fluidic paths within the printing device.

The printing system (200) may include a carriage (205) fluidically coupled to a fluid reservoir (215) via a tube (220). The carriage (205) may further include a first fluidic valve (210) that is fluidically coupled with the carriage (205) and tube (220) as well as with a removeable housing. Although FIG. 2 shows the presence of a single fluidic valve (210), the present specification contemplates that the carriage (205) includes a number of fluidic valves (210). In an example, the carriage (205) may include a first fluidic valve (210) as well as a second fluidic valve, a third fluidic valve, and a fourth fluidic valve such that the first, second, third, and fourth fluidic valves are fluidically coupled to a first, a second, a third, and a fourth fluidic reservoir respectively via respective tubes. Each of the first, second, third, and fourth fluidic reservoirs may maintain different types of printing fluid therein for use during a printing process. In an example, the first, second, third, and fourth fluidic reservoirs may maintain a first color of printing fluid, a second color of printing fluid, a third color of printing fluid and a fourth color of printing, fluid respectively.

Figure 5A:
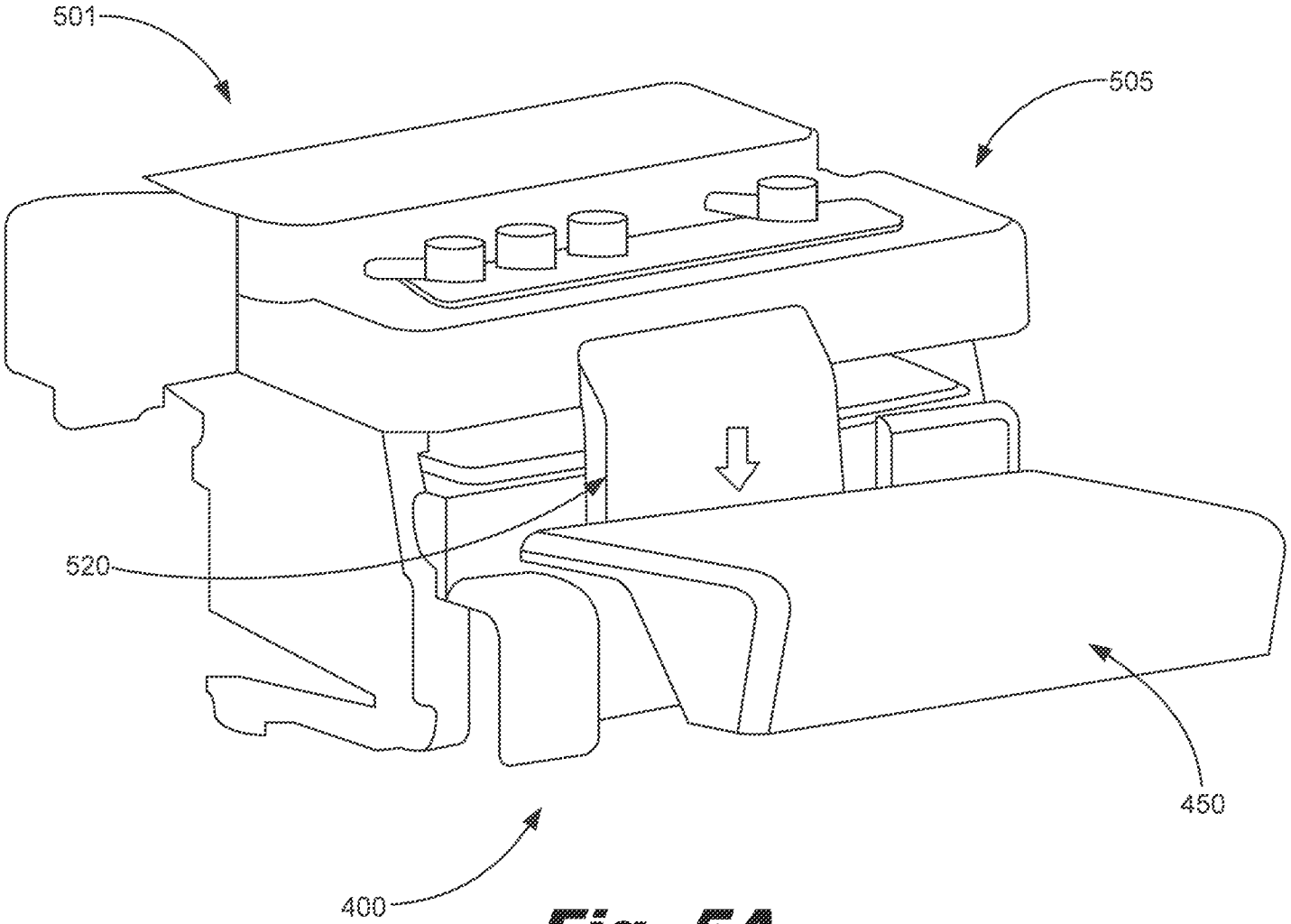
FIG. 5A is an isometric view of an air purging system according to an example, of the principles described herein.
Figure 5B:
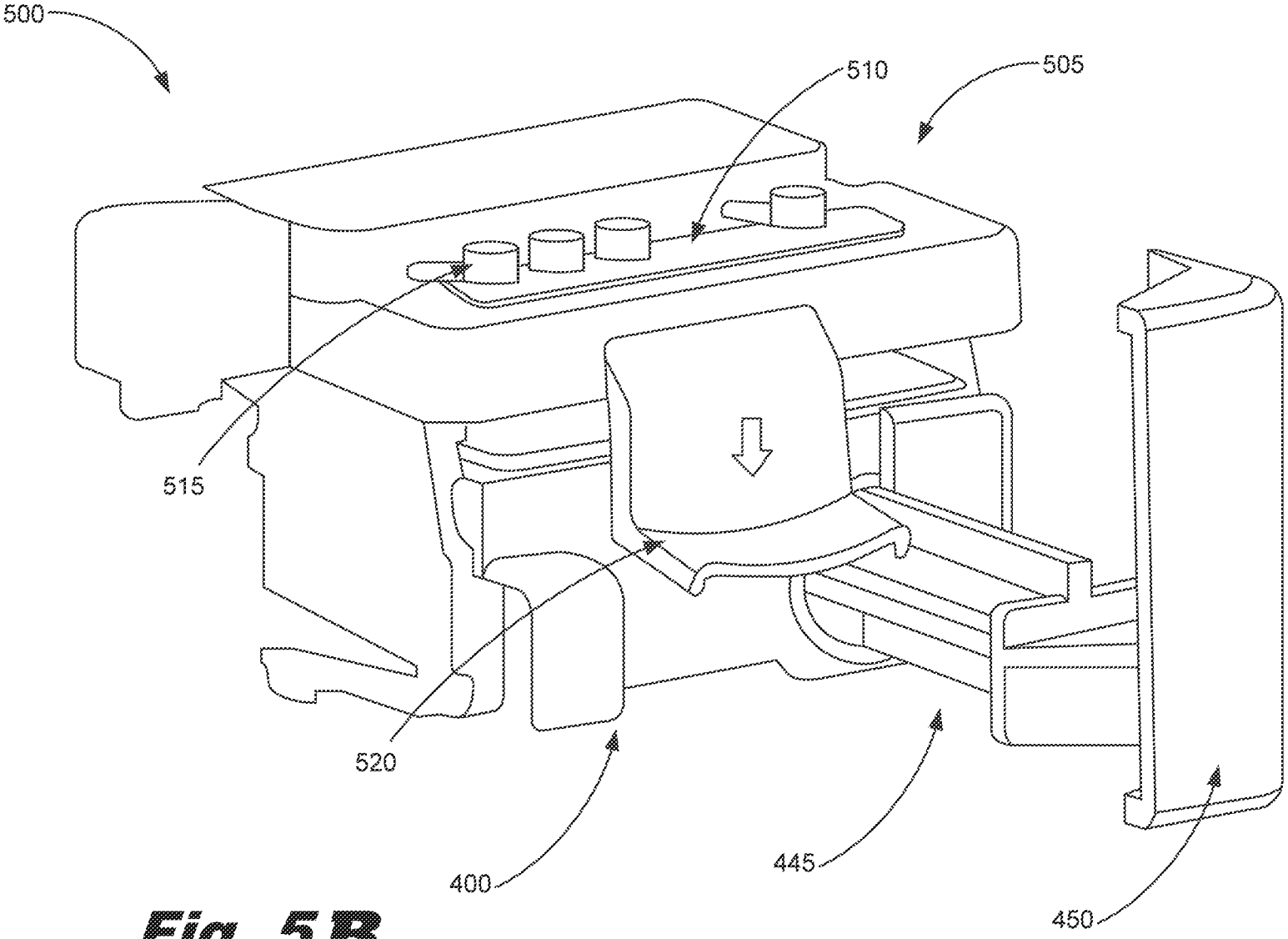
FIG. 5B is an isometric view of an air purging system according to an example, of the principles described herein.

In the example where the carriage (205) includes a plurality of fluidic valves (210), a matching number of fluid interfaces (230) may be present on the removeable housing (225). The fluid interface (230) fluidically couples the fluid reservoir (215), the tube (220), and the first fluidic valve (210) to a bore (235) defined in the removeable housing (225). The bore (235) may have a plunger (240) therein. The plunger (240), when moved from a first orientation to a second orientation, may cause a vacuum to be formed within the bore (235) as well as provide physical access to a coupling device (e.g., a latch as illustrated in FIG. 5A and FIG. 5B) used to secure the removeable housing (225) to the carriage (205) as described herein. Operation of the printing system (200) and, specifically, the removeable housing (225) may be similar to the operation of the air purging device (FIG. 1, 100) used in the printing device described herein in connection with FIG. 1. In this example, moving the plunger (240) from a first orientation to a second orientation also allows for the removal of the removeable housing (225) in order to allow a fluidic die and/or fluidic die housing to be coupled to the carriage (205). In this way, the removeable housing (225) serves as a temporary device that purges air from a number of locations within a fluid path of a printing device so as to prevent damage to any fluidic dies of the printing device.

In an example, the removeable housing (225) may also include a porous plug within the fluid interface (230) that, when printing fluid contacts the porous plug, prevents printing fluid from entering the bore (235) as well as prevents air from entering the first fluidic valve (210) and/or tube (220).

In an example, the bore (235) may also include a spring that imparts a force against the plunger (240). As the plunger (240) is moved from the first orientation to the second orientation, the spring may force the plunger (240) coaxially within the bore (235).

In an example, the bore (235) may further include a seal or gasket the prevents air from outside of the bore (235) from entering the bore (235) as the plunger (240) is removed. This allows a vacuum to be formed within the bore (235) causing the purging of air from within the first fluidic valve (210) and tube (220) as described herein.

Figure 3:
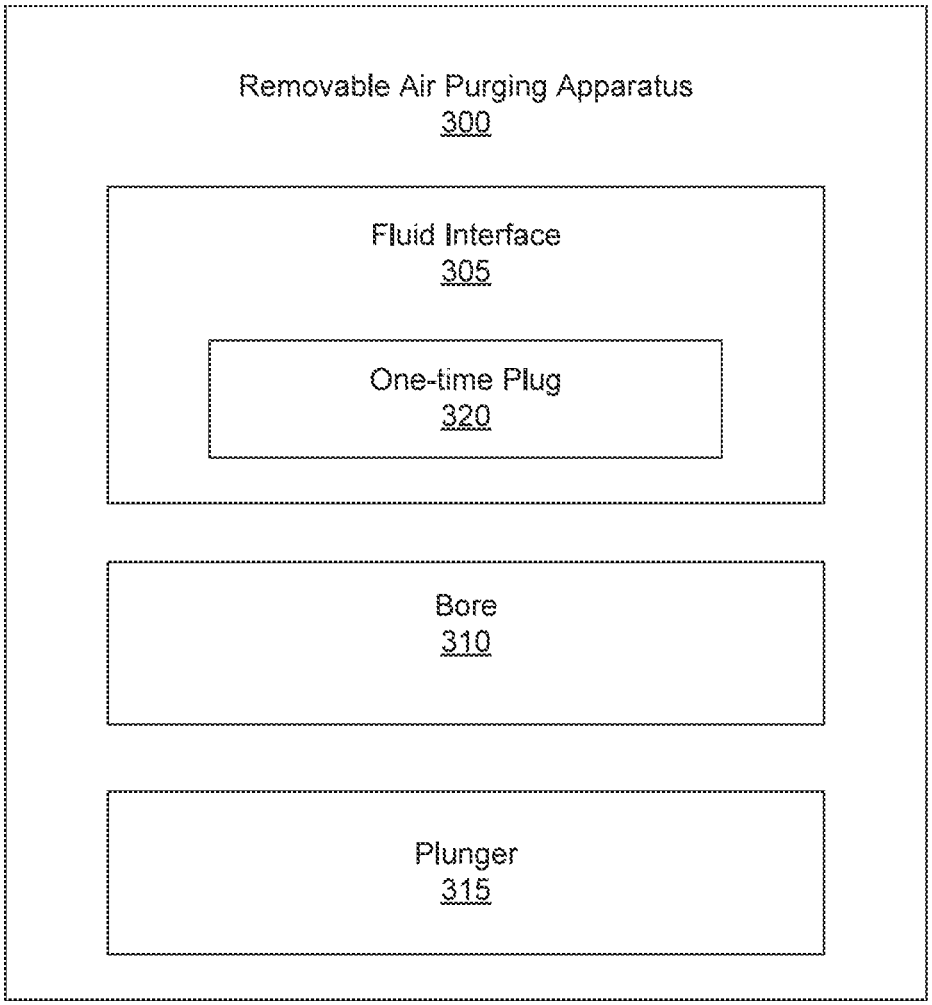
FIG. 3 is a block diagram of a removable air purging apparatus (300) according to an example of the principles described herein.

FIG. 3 is a block diagram of a removable air purging apparatus (300) according to an example of the principles described herein. The air purging apparatus (300) may include a fluid interface (305), a bore (310), and a plunger (315). The fluid interface (305) may also include a one-time plug (320). As described herein, the removable air purging apparatus (300) may interface with a carriage on a printing device in order to purge an amount of air from within a number of fluid paths of the printing device including a number of tubes fluidically coupling a fluid reservoir to the carriage. The air may be purged by operation of the plunger (315) within the bore (310). Moving the plunger (315) from a first orientation to a second orientation allows for a portion of the plunger (315) to be removed from the bore (310) creating a vacuum within the bore (310). Because the bore (310) is fluidically coupled to the fluidic paths within the printing device via the fluid interface (305), air from these locations is pulled into the bore (310) along with an amount of printing fluid from the reservoirs.

In the examples in which multiple fluid interfaces (305) are present, each fluid interface (305) may include its own one-time plug (320). As air is pulled from the fluid paths within the printing device, an amount of printing fluid may also be pulled from any number of fluid reservoirs. As the printing fluid comes in contact with the one-time plug (320), the one-time plug (320) may swell causing its respective fluid interface (305) to be plugged up preventing printing fluid from entering the bore (310) and air from reentering the fluid paths of the printing device. The swelling of each of the one-time plugs (320) may not occur simultaneously. Consequently, as a first one-time plug (320) swells due to contact with the printing fluid, other one-time plugs (320) may still be allowing an amount of air to pass therethrough. Because all of the fluid interfaces (305) are fluidically coupled to the bore (310), as less than all of the one-time plugs (320) are not swollen, the vacuum pressure created by removal of the plunger (315) from the bore (310) continues to pull an amount of printing fluid through the tubes until all of the one-time plugs (320) have contacted some printing fluid and have become swollen. Thus, although vacuum pressure may change as any number of one-time plugs (320) have become swollen, some fluid interfaces (305) remain open until all air is removed from all fluid paths within the printing device and fluid swells the one-time plug (320).

Figure 4:
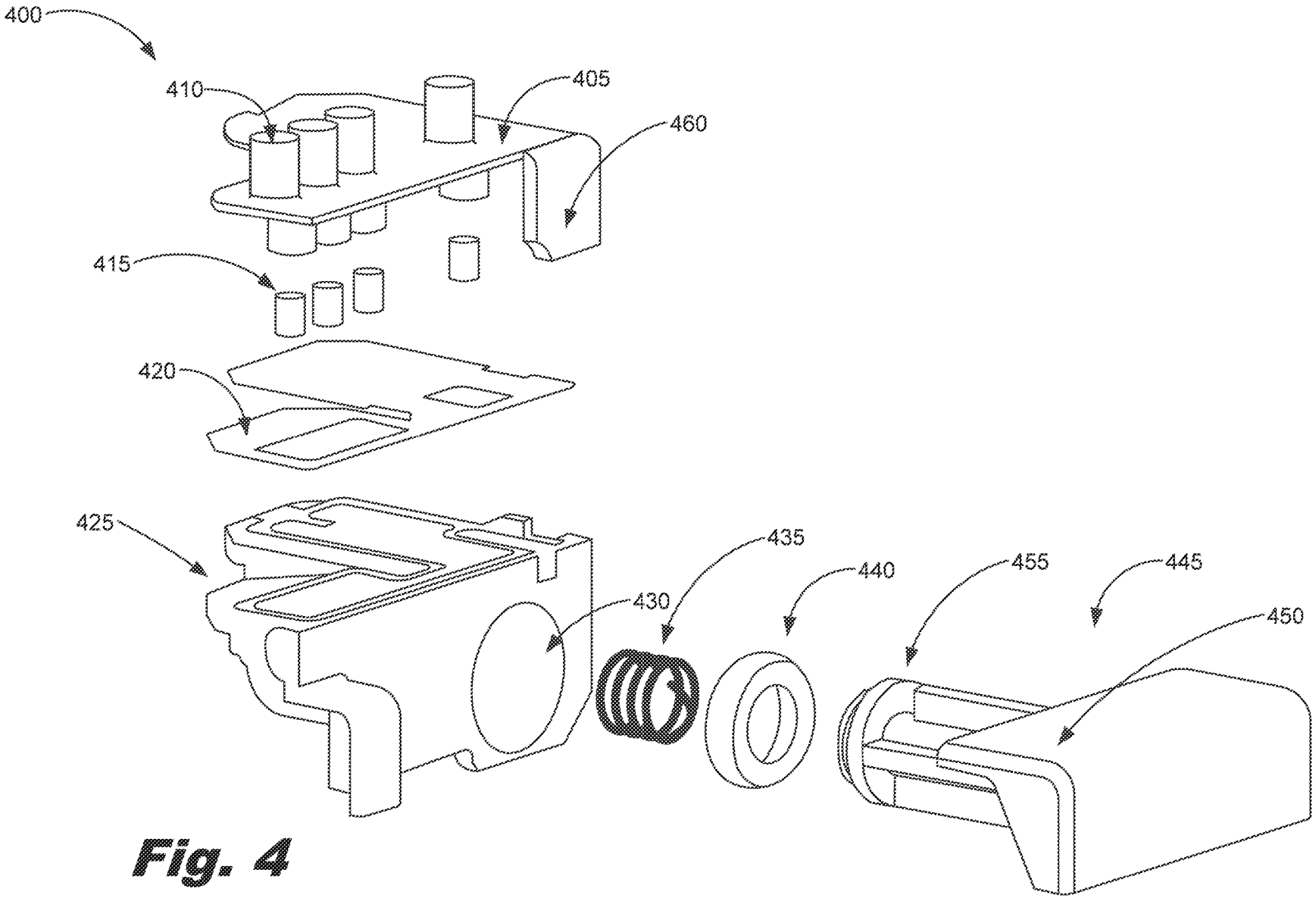
FIG. 4 is an isometric exploded view of an air purging device according to an example of the principles described herein.

FIG. 4 is an isometric exploded view of an air purging device (400) according to an example of the principles described herein. The air purging device (400) may be similar to the air purging device (FIG. 1, 100), the removable housing (FIG. 2, 225), and the removable air purging apparatus (FIG. 3, 300) of FIGS. 1, 2, and 3 respectively and similar elements and functions may be realized in the example air purging device (400) of FIG. 4.

The air purging device (400) may include a top plate interface (405) that includes a fluid interface (410). In the example shown in FIG. 4, the top plate interface (405) includes four distinct fluid interfaces (410). In this example, the four fluid interfaces (410) may interface with an individual fluidic valve of a carriage of a printing device. In turn, each of the fluidic valves of the carriage may be fluidically coupled to a reservoir via a tube. In an example, each of the reservoirs may contain distinct types of printing fluid to be provided to the carriage and, eventually, to a fluidic die as described herein.

Each of the fluid interfaces (410) may include a porous plug (415). The porous plug (415) may be any type of device that prevents printing fluid from entering a bore (430) while, simultaneously, bleeding any fluid paths upstream of the air purging device (400). In an example, the porous plug (415) may be chemically treated with, for example, a crosslinked polyacrylamide, such that when the printing fluid reaches the porous plug (415), the porous plug (415) swells blocking the fluid interface (410).

The air purging device (400) may further include a body (425) that is coupled to the top plate interface (405) with a gasket (420) provided between. The body (425) may be made of any rigid material with sufficient rigidity to withstand a vacuum created therein by the plunger (445) during operation. The gasket (420) may help to maintain a vacuum created within the body (425) by preventing equalization of air pressure between atmosphere and the inside of the bore (430) especially at the coupling locations between the body (425) and top plate interface (405).

The body (425) may further include a bore (430) defined therein. The size and volume of the bore (430) may depend on a number of factors including the amount of air to be purged from the fluid path within the printing device. The bore (430) may, therefore, be fluidically coupled, via the fluid interface (410), to the fluid path within a printing device including a fluidic valve, tubes, and reservoirs.

The plunger (445) may have a body shape that conforms to the interior surface of the bore (430). In the example shown in FIG. 4, because the bore (430) has a general tubular shape a portion of the plunger (445) has a columnar shape. The plunger (445) may include a handle (450) that a user may use in order to interface with the air purging device (400) as described herein.

In an example, the air purging device (400) may further include a seal (440) that is placed between an innermost wall of the bore (430) and a distal end (455) of the plunger (445). The seal helps to prevent equalization of pressure between the inside of the bore (430) and the outside of the air purging device (400) while the plunger (445) is being removed from the bore (430) as described herein.

In an example, the bore (430) may also include a spring (435) that forces the plunger (445) within the bore (430). As described above, the plunger (445) is retained within the bore (430) by use of a plunger retainer (460). The plunger (445) itself may include any number of surfaces that, when the plunger (445) is in a first orientation as shown in FIG. 4 and further illustrated in FIG. 5A, prevents the plunger (445) from being removed from the bore (430). This second orientation, in an example, includes a 90-degree rotation of the plunger (445) to a point where the handle (450) of the plunger (445) is perpendicular to its orientation presented in FIG. 4, as illustrated in FIG. 5B. In other examples, the degree of rotation of the plunger (445) within the bore (430) may vary. In an example, the degree of rotation of the plunger (445) may be such so as to clear a latch coupling the housing to the carriage. The spring (435), when the plunger (445) is in the second orientation, helps to push the columnar portion of the plunger (445) within the bore (430). In an example, the plunger (445) may be completely removed from the bore (430). In an example, the plunger (445) may be prevented from being removed completely from the bore (430) by use of a number of interfaces between the inner surface of the bore (430) and the plunger (445). In this example, a portion of the distal end (455) may remain within the bore (430) after the plunger (445) has been moved into the second orientation.

FIG. 5A is an isometric view of an air purging system (501) according to an example, of the principles described herein. The air purging system (501) may include the air purging device (400) described in connection with FIG. 4.

FIG. 5A shows the handle (450) in the first orientation as described herein. FIG. 5A further shows a latch (520) used to couple the air purging device (400) to the carriage (505) during operation of the air purging device (400). While the handle (450) of the air purging device (400) is in the first orientation, as shown in FIG. 5A, the handle (450) prevents access to the latch (520) by a user.

FIG. 5B is an isometric view of an air purging system (500) according to an example, of the principles described herein. The air purging system (500) may include the air purging device (400) described in connection with FIG. 4 and the air purging device (400) described in connection with FIG. 5A.

FIG. 5B shows the plunger (445) with its handle (450) in the second orientation as described herein. The air purging system (500) may include a carriage (505) of a printing device used to hold a fluidic die therein. The carriage (505) may include a manifold (510) have a number of fluidic valves (515) that interface with the fluid interface (FIG. 4, 410) of the air purging device (FIG. 4, 400). Each fluidic valve (515) of the manifold (510) may be fluidically coupled to a reservoir via a number of tubes. It is these tubes from which the air purging device (FIG. 4, 400) of the air purging system (500) pulls air and printing fluid through until it reaches the porous plugs (FIG. 4, 415) of the air purging device (400).

FIG. 5B further shows a latch (520) used to couple the air purging device (400) to the carriage (505) during operation of the air purging device (400). However, when the handle (450) of the air purging device (400) is in the first orientation as shown in FIG. 4 and FIG. 5A, the handle (450) prevents access to the latch (520) by a user. When the user moves the handle (450) to the second orientation as shown in FIG. 5B, however, the user is allowed access to the latch (520). Because the air purging device (400) is removable after air has been purged from the tubes, the user may actuate this latch (520) in order to remove the air purging device (400). For example, the user may activate this latch (520) by lifting the latch in order to access the air purging device (400). As such, the air purging system (500) has a mechanical arrangement that prevents the user from removing the air purging device (400) until after the user has orientated the handle (450) in the second orientation thereby causing air to be purged from the tubes and other fluid paths within the printing device. Graphical indicators may be formed on the surfaces of the handle (450) and/or latch (520) indicating how and which devices a user is to interact with during this setting-up process. As a result, the air purging device (400) purges air from the system before the user us allowed to access a latch to release the air purging device from the carriage.

In an example, once the air is purged from the fluid paths within the printing device, the user may actuate the latch (520). In the example shown in FIG. 5B, the latch may be lifted up to cause the carriage (505) to rise up to allow the user to pull the air purging device (400) from the carriage (505) thereby removing the air purging device (400) from the air purging system (500). The user may then place a fluidic die and/or fluidic die body into the void made by the air purging device (400) and begin to use the printing device. Because the fluidic paths within the printing device upstream of the air purging device (400) had been purged of air, the new interface between the manifold (510) of the carriage (505) and any fluidic die and/or fluidic die body will also be purged of air. Consequently, the probability of damage occurring to the fluidic dies due to any inclusion of air is reduced.

Figure 6:
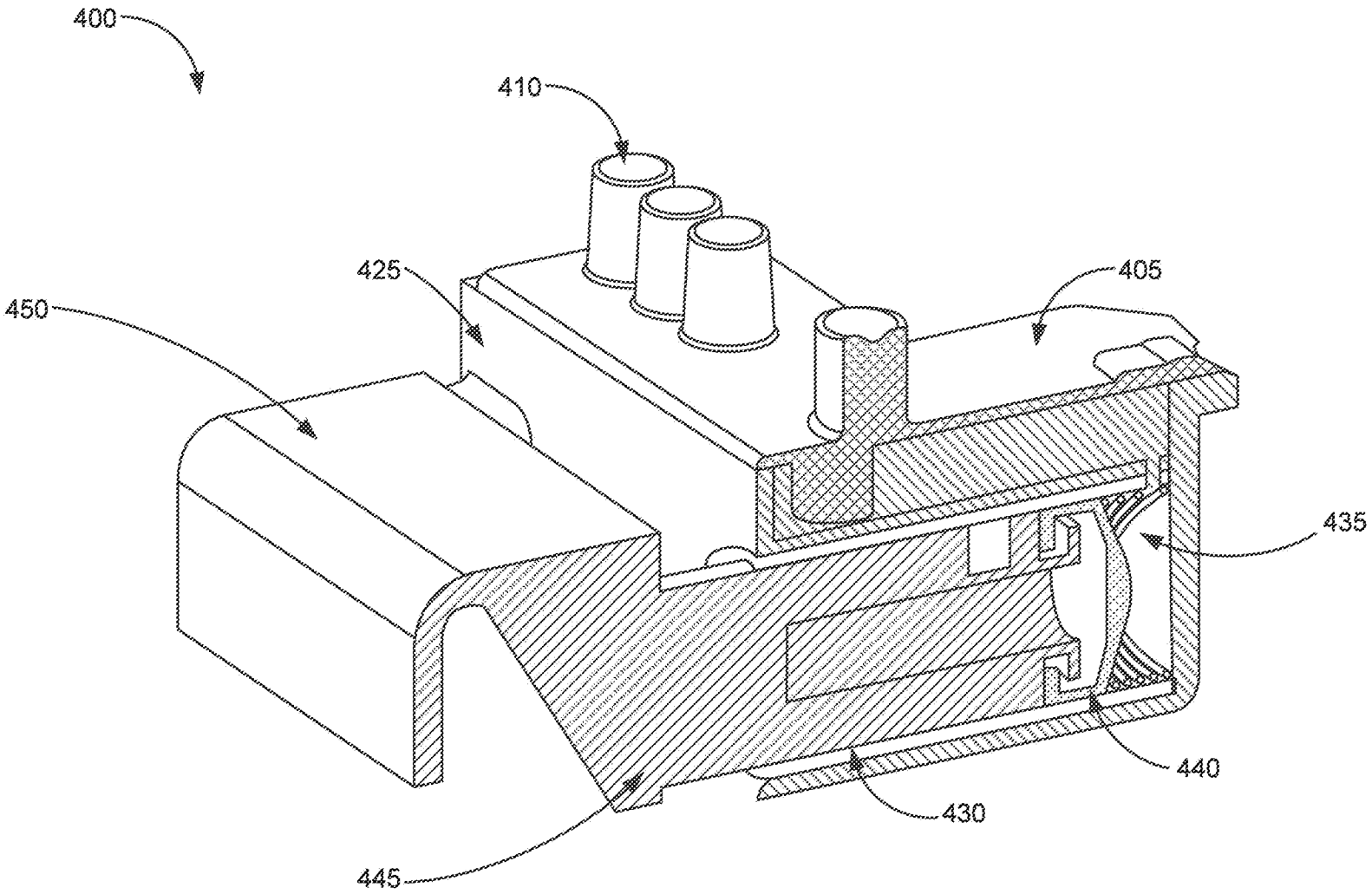
FIG. 6 is an isometric cut-away view of the air purging device according to an example of the principles described herein.

FIG. 6 is an isometric cut-away view of the air purging device (400) according to an example of the principles described herein. In this example, the plunger (445) is in the first orientation with the columnar portion of the plunger (445) fully engaged with the bore (430). In the example show in FIG. 6, the air purging device (400) includes a spring (435) placed within the bore (430) resistively pushing against the plunger (445). When the plunger (445) is placed in the second orientation, the spring (435) may be allowed to push the plunger (445) within the bore (430) partially so as to create a vacuum within the bore (430). In an example, the air purging device (400) does not include a spring (435) and instead the user may pull on the handle (450) of the plunger (445) after the plunger (445) is moved to the second orientation in order to create the vacuum described herein.

In this example shown in FIG. 6, the bore (430) is in fluid communication with the fluid interfaces (410) via a number of fluidic paths formed within the body (425) of the air purging device (400). Although FIG. 6 shows a specific layout of fluid paths formed in the body (425), the present specification contemplates that the fluid interface (410) may be fluidically coupled to the bore (430) in any arrangement, including a cavity, that allows the bore (430) to maintain a vacuum in the bore (430) when the plunger (445) is removed from the bore (430).

The air purging device (400) shown in FIG. 6 also includes the seal (440) that helps to maintain the vacuum within the bore (430) when the plunger (445) is in the second orientation. Lubricants may be used in connection with the seal (440) in order to create the atmospheric seal between the bore (430) and atmosphere. In an example, the seal (440) may be coupled to the end of the plunger (445) with the spring (435) pressing against a surface of the seal (440).

Figure 7:
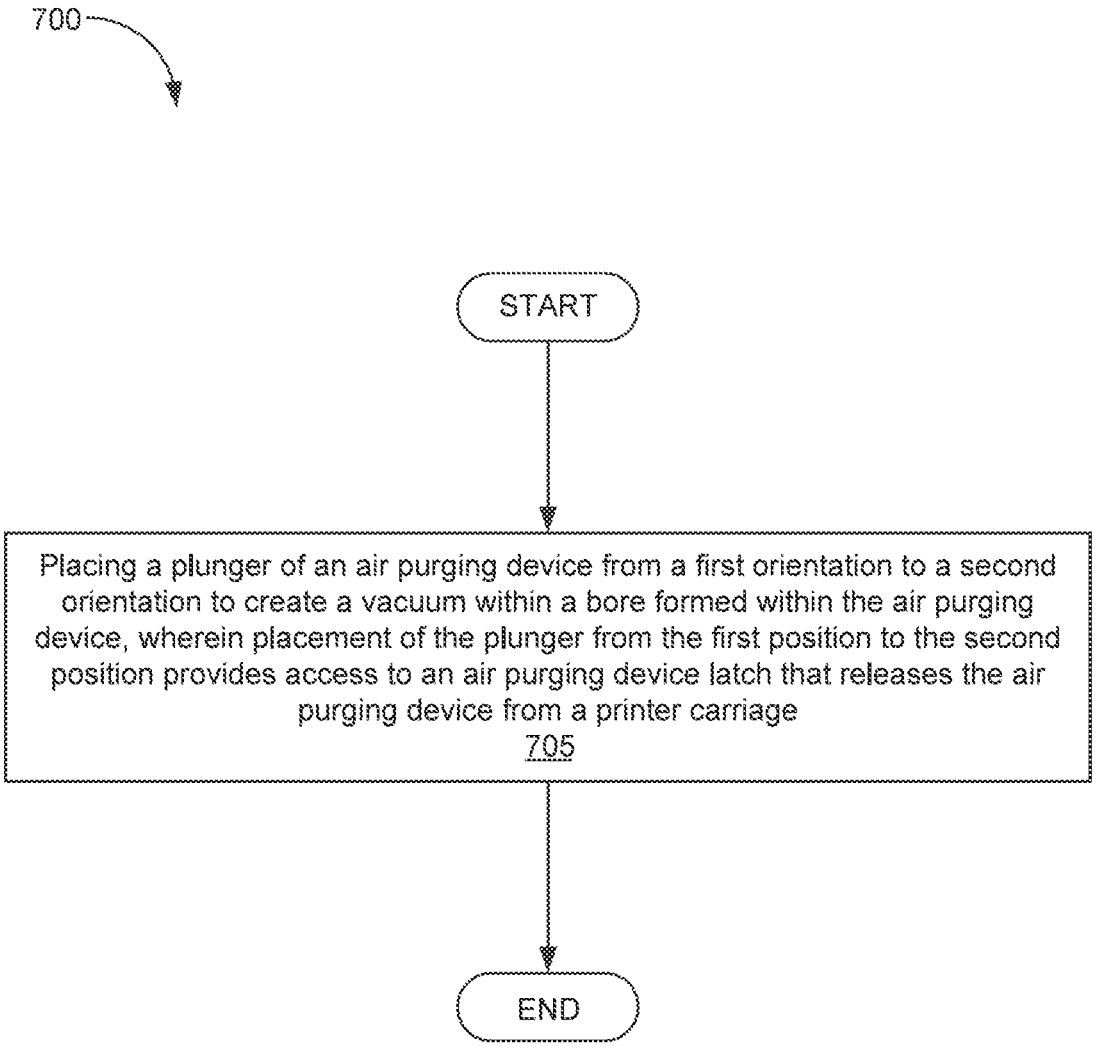
FIG. 7 is a flowchart showing a method according to an example of the principles described herein.

FIG. 7 is a flowchart showing a method (700) according to an example of the principles described herein. The method (700) may begin with placing (705) a plunger of an air purging device from a first orientation to a second orientation to create a vacuum within a bore formed within the air purging device. In an example, the placement of the plunger from the first orientation to the second orientation provides access to an air purging device latch that releases the air purging device from a printer carriage.

The method (700) may further include activating the latch to release the air purging device from the carriage. In an example, the latch may be pushed down towards the air purging device in order to activate the latch thereby unlatching the air purging device from the carriage. In another example, the latch may be lifted up, away from the air purging device in order to access the air purging device. Although a certain type of latch is described and depicted herein, any type of coupling device may be used. However, the present specification contemplates that the movement of the plunger from the first to the second orientation as described herein allows for activation and/or lifting of the latch. This is done such that an operator cannot unlatch the air purging device until the plunger has been moved from the first orientation to the second orientation.

As described herein, the vacuum may be created by a user rotating the plunger from a first orientation to a second orientation. In this example, the spring may provide the force used to push the plunger within the bore to create the vacuum therein. In another example, the vacuum may be created by a user rotating the plunger from a first orientation to a second orientation and then pulling the plunger away from the air purging device to create the vacuum. In this example, the spring is not used and instead the users force against the handle of the plunger creates that vacuum in the bore.

The specification and figures describe an air purging device with a plunger. The plunger forms part of a removable air purging device that is removed once the plunger is moved from a first orientation to a second orientation. This allows for a user to know that the air has been purged before removing the air purging device and replacing it with a fluidic device. Additionally, the air purging device described herein interfaces with an existing manifold of a carriage in the printing device. Consequently, the air purging device and a later installed fluidic die may both interface similarly with the manifold.

The preceding description has been presented to illustrate and describe examples of the principles described. This description is not intended to be exhaustive or to limit these principles to any precise form disclosed. Many modifications and variations are possible in light of the above teaching.

What is claimed is:

1. An air purging device, comprising:

a housing, the housing comprising:

a fluid interface to fluidically couple a fluid tube to the housing;

a bore fluidically coupled to the fluid interface; and a movable plunger housed in the bore, wherein movement of the plunger from a first orientation to a second orientation allows for:

the plunger to be translated coaxially within the bore, removing a first portion of the plunger from the bore to create a vacuum within the bore, the fluid interface, and the fluid tube;

access to a coupling device of a printer carriage coupled to the housing, the coupling device blocking removal of the air purging device from the printer carriage while the plunger is in the first orientation and prior to translating of the plunger within the bore; and actuation of the coupling device for removal of the air purging device from the printer carriage.

2. The air purging device of claim 1, comprising a spring mounted within the bore to apply a force against the plunger.

3. The air purging device of claim 1, comprising a plunger retainer to maintain a second portion of the plunger within in the bore when the plunger is in the first orientation.

4. The air purging device of claim 3, wherein placing the plunger in the second orientation comprises twisting the plunger within the bore to bypass the plunger retainer to allow the plunger to be translated within the bore.

5. The air purging device of claim 1, comprising a seal placed between the plunger and housing within the bore to seal off an internal portion of the housing from atmosphere when a third portion of the plunger is translated within the bore.

6. The air purging device of claim 1, wherein translating of the plunger within the bore creates the vacuum within the housing to pull fluid through the fluid tube.

7. The air purging device of claim 1, comprising a porous plug that seals the fluid interface when a liquid comes in contact with the porous plug.

8. A printing system, comprising:

a carriage comprising a first fluidic valve fluidically coupled, via a tube, to a fluid reservoir; and a housing removably coupled to the carriage, the housing comprising:

a first fluid interface fluidically coupled to the first fluidic valve;

a bore fluidically coupled to the first fluid interface; and a plunger housed within the bore, wherein movement of the plunger from a first orientation to a second orientation allows for:

the plunger to be translated coaxially within the bore, removing a portion of the plunger from the bore to create a vacuum within the bore and the first fluid interface;

access to a latch of the carriage coupled to the housing, the latch blocking removal of the housing from the carriage while the plunger is in the first orientation and prior to translating of the plunger within the bore; and removal of the housing from the carriage.

9. The printing system of claim 8, comprising a one-time plug within the first fluid interface to seal the first fluid interface when a fluid contacts the one-time plug.

10. The printing system of claim 8, comprising a second fluidic valve, a third fluidic valve, and a fourth fluidic valve wherein the first, second, third, and fourth fluidic valves are fluidically coupled to a first, a second, a third, and a fourth fluidic reservoir respectively wherein the first, second, third, and fourth fluidic reservoirs maintain a first color of printing fluid, a second color of printing fluid, a third color of printing fluid and a fourth color of printing fluid respectively.

11. The printing system of claim 10, comprising a second fluid interface, a third fluid interface, and a fourth fluid interface fluidically coupled to the bore, wherein the first, second, third, and fourth fluid interface are fluidically coupled to the first fluidic valve, the second fluidic valve, the third fluidic valve, and the fourth fluidic valve respectively.

12. The printing system of claim 8, wherein the carriage latch latches the carriage to the housing and wherein movement of the plunger from the first orientation to the second orientation provides access to the carriage latch allowing for lifting of the latch for removal of the housing from the carriage.

13. A method comprising:

placing a plunger, of an air purging device fluidically coupled to a printer carriage, from a first orientation to a second orientation;

translating the plunger coaxially within a bore formed within and fluidically coupled to the air purging device to create a vacuum within the bore, the air purging device, and the printer carriage;

wherein placement of the plunger from the first orientation to the second orientation provides for:

allowing the plunger to be translated coaxially within the bore, removing a portion of the plunger from the bore to create the vacuum within the bore, the air purging device, and the printer carriage;

access to a latch of the printer carriage that releases the air purging device from the printer carriage; and removal of the air purging device from the printer carriage.

14. The method of claim 13, comprising lifting the latch to release the air purging device from the carriage.

15. The method of claim 13, comprising pulling the plunger within the air purging device to create the vacuum within the bore, the air purging device, and the printer carriage.

16. The air purging device of claim 1, wherein the coupling device is a latch and lifting of the latch of the carriage permits removal of the air purging device from a void in the carriage.

17. The air purging device of claim 16, further comprising a handle on the plunger rotatable between first and second orientations, wherein, in the first orientation, the handle covers the latch to prevent lifting of the latch and removal of the air purging device.

18. The air purging device of claim 7, wherein the porous plug comprises a treated portion and an untreated portion, the treated portion being located closest to the bore and swelling in response to contact with printing fluid so as to seal the fluid interface.

19. The printing system of claim 8, wherein the fluidic valve is a one-way valve to prevent air from entering the tube after removal of the plunger.

20. The printing system of claim 8, further comprising a fluidic die to be engaged in a void of the carriage after the housing is removed from the void in the carriage.

* * * * *